US010267113B2

(12) United States Patent
Mineo et al.

(10) Patent No.: US 10,267,113 B2
(45) Date of Patent: Apr. 23, 2019

(54) SLICKLINE SHREDDER

(71) Applicant: Halliburton Energy Services, Inc., Houston, TX (US)

(72) Inventors: Richard Mineo, Richardson, TX (US); Dominick Joseph Bellotte, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 36 days.

(21) Appl. No.: 15/542,681

(22) PCT Filed: Feb. 12, 2015

(86) PCT No.: PCT/US2015/015658

§ 371 (c)(1),
(2) Date: Jul. 11, 2017

(87) PCT Pub. No.: WO2016/130131

PCT Pub. Date: Aug. 18, 2016

(65) Prior Publication Data

US 2017/0350207 A1 Dec. 7, 2017

(51) Int. Cl.

| | |
|---|---|
| ***E21B 29/04*** | (2006.01) |
| ***E21B 31/12*** | (2006.01) |
| ***E21B 31/16*** | (2006.01) |
| ***E21B 27/00*** | (2006.01) |
| ***E21B 47/00*** | (2012.01) |
| *E21B 17/00* | (2006.01) |
| *E21B 19/00* | (2006.01) |

(52) U.S. Cl.

CPC ..... *E21B 29/04* (2013.01); *E21B 27/00* (2013.01); *E21B 31/125* (2013.01); *E21B 31/16* (2013.01); *E21B 47/00* (2013.01); *E21B 17/003* (2013.01); *E21B 19/008* (2013.01)

(58) Field of Classification Search

CPC ..... E21B 29/04
USPC ..... 166/376
See application file for complete search history.

(56) References Cited

U.S. PATENT DOCUMENTS

| | | | | |
|---|---|---|---|---|
| 3,073,388 A | | 1/1963 | Chenault | |
| 3,926,252 A | | 12/1975 | Ribeyre et al. | |
| 4,374,573 A | * | 2/1983 | Rouse | B02C 18/142 241/101.76 |
| 5,070,952 A | | 12/1991 | Neff | |

(Continued)

FOREIGN PATENT DOCUMENTS

| | | | |
|---|---|---|---|
| CN | 204309159 U | * | 5/2015 |
| WO | 2015003188 A1 | | 1/2015 |

OTHER PUBLICATIONS

International Searching Authority, Patent Cooperation Treaty, International Search Report and Written Opinion, International application No. PCT/US2015/015658, entire document, which is a PCT parent to the instant application, dated Oct. 19, 2015.

*Primary Examiner* — Taras P Bemko
(74) *Attorney, Agent, or Firm* — Howard L. Speight, PLLC

(57) ABSTRACT

A slickline shredder tool includes a housing, a housing inlet, a power receiver, a shredder coupled to the power receiver, and a storage unit. The shredder rotates about a first axis when the power receiver receives power. Malfunctioning slickline enters the housing through the housing inlet and is shredded into shredded pieces by the shredder. The shredded pieces are stored in the storage unit.

20 Claims, 8 Drawing Sheets

(56) References Cited

U.S. PATENT DOCUMENTS

| | | | | |
|---|---|---|---|---|
| 5,720,348 | A | 2/1998 | Hisaw | |
| 6,763,753 | B1 | 7/2004 | Brumley et al. | |
| 6,789,627 | B2 | 9/2004 | Leismer | |
| 6,868,901 | B2 | 3/2005 | Mason et al. | |
| 7,128,155 | B2 | 10/2006 | Cho | |
| 7,422,055 | B2 | 9/2008 | Cruickshank et al. | |
| 8,082,980 | B2 | 12/2011 | Gillan | |
| 8,210,251 | B2 | 7/2012 | Lynde et al. | |
| 2003/0183393 | A1 | 10/2003 | Fincher et al. | |
| 2008/0149349 | A1 | 6/2008 | Hiron et al. | |
| 2012/0292112 | A1 | 11/2012 | Lakic | |
| 2014/0000895 | A1 | 1/2014 | Misselbrook | |
| 2014/0311741 | A1 | 10/2014 | Tunget | |
| 2015/0240583 | A1* | 8/2015 | Mineo | E21B 34/063 166/311 |
| 2016/0138369 | A1* | 5/2016 | Tunget | E21B 37/02 166/311 |

* cited by examiner

SLICKLINE SHREDDER

BACKGROUND

A slickline cable is typically used to lower a downhole tool into a borehole. Once the tool has been used for its intended task, the operator may pull the tool out of the borehole by winding the slickline onto a drum from which it was spooled. A slickline cable may break or become stuck in the borehole requiring a "fishing" job to remove the slickline. Such a fishing operation can be a challenge.

DETAILED DESCRIPTION

While this disclosure describes a land-based slickline system, it will be understood that the equipment and techniques described herein are applicable in sea-based systems, multilateral wells, and similar environments.

Figure 1:
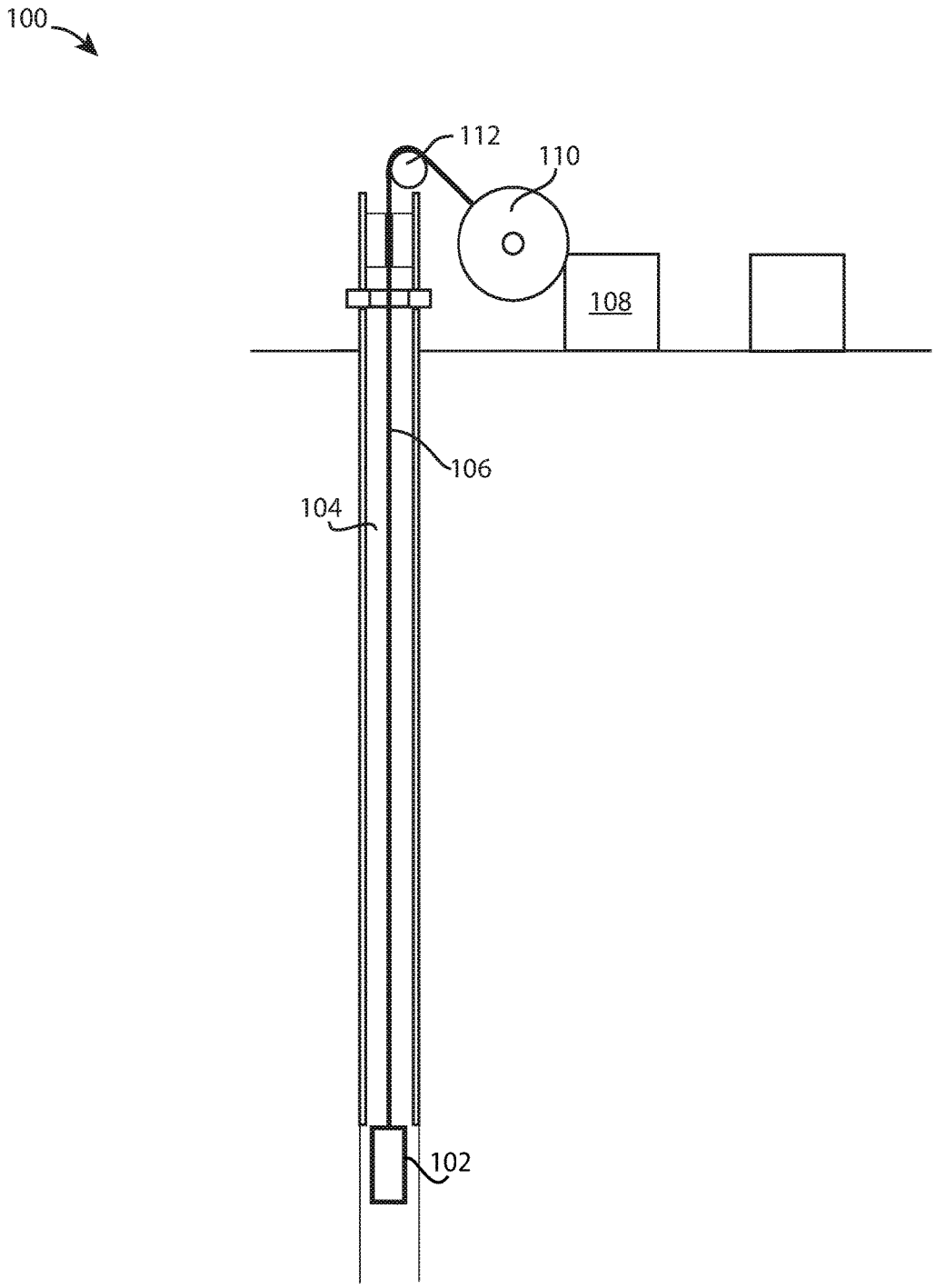
FIG. 1 illustrates a slickline system with a tool deployed into the borehole.

In one or more embodiments, as illustrated in FIG. 1, a slickline system 100 is used to convey a tool 102 (or tools) into a borehole 104 and retrieve the tool 102 therefrom. In one or more embodiments, a slickline cable 106, may be thin, hard, and rigid, such as the composite slickline described in WO 2014/137335 (entitled "Bonded Slickline and Methods of Use"), which is assigned to the assignee of the present application, however the slickline system 100 may instead use a wire slickline cable 106 with different material properties and varied physical dimensions. In one or more embodiments, the slickline cable 106 provides a forward path for signals from the tool 102 to a surface equipment module 108 located on the surface of the earth, or vice versa, as described in U.S. Pat. No. 8,547,246 (entitled "Telemetry System for slickline enabling real time logging"), which is assigned to the assignee of the present application. In one or more embodiments, the slickline cable 106 is stored on a draw works or spool 110 and proceeds through a pulley or system of pulleys 112 and through a packing assembly (not shown). In one or more embodiments, the slickline cable 106 proceeds through a blow-out preventer (not shown) that enables personnel to seal the well if, for example, the packing assembly fails.

In one or more embodiments, the slickline cable 106 is electronically and mechanically coupled to the tool 102. In one or more embodiments, the coupling between the slickline cable 106 and the tool 102 is a sturdy mechanical connection, capable of sustaining the connection through the entire slickline operation. In one or more embodiments, there is an electronic or optical connection between the slickline cable 106 and the tool 102. In one or more embodiments, the electrical and mechanical connection between the slickline cable 106 and the tool 102 is a conventional connection between a cable and a relatively heavy load. In one or more embodiments, the tool 102 includes sensors and actuators, such as probes, pressure sensors, and acoustic sensors. It will be understood that the slickline system 100 may include other equipment as needed. In one or more embodiments, there is no electrical or optical connection between the slickline cable 106 and the tool 102.

In one or more embodiments, the tool 102 and the surface equipment module 108 each contain a modem (not shown). In one or more embodiments, the modems allow half duplex or full duplex signaling between the tool 102 and the surface equipment module 108 by using standard modem communication techniques. In one or more embodiments, the data that is transferred between the tool 102 and the surface equipment module 108 can be of almost any type. For example, in one or more embodiments, the tool 102 transmits logging data as it is collected. In one or more embodiments, the data is checked at the surface and new logging parameters are transmitted from the surface equipment module 108 to the tool 102, without having to retrieve the tool 102 to the surface. In one or more embodiments, the surface equipment module 108 is coupled to a remote real time operating center (not shown) so that data received from other remote wells may be used in making logging decisions for the well being logged.

Figure 2:
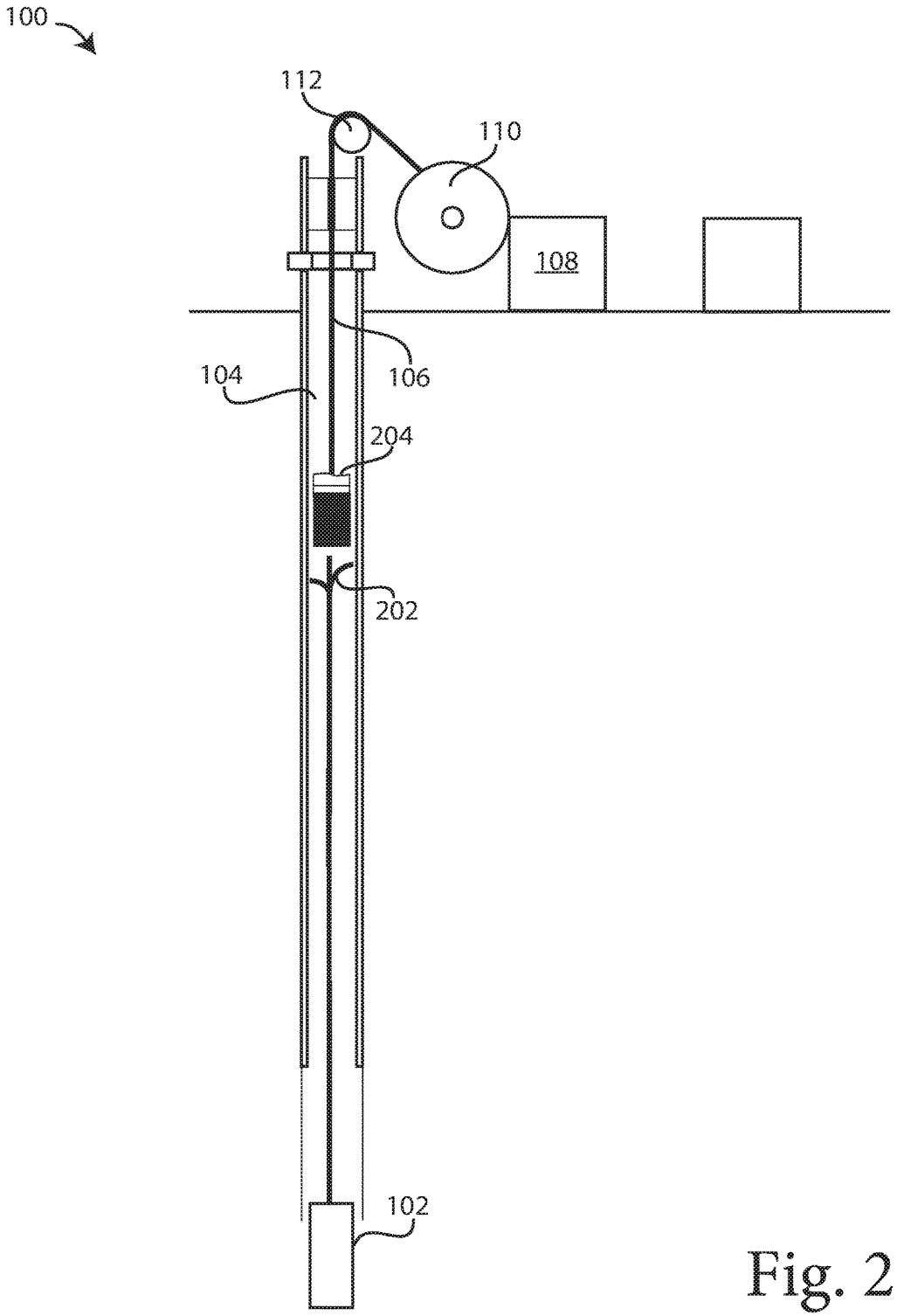
FIG. 2 illustrates a slickline shredder tool deployed into the borehole to engage with malfunctioning slickline.

In one or more embodiments, as illustrated in FIG. 2, the slickline cable 106 in the slickline system 100 may be rendered unresponsive in the borehole 104 because it is stuck and/or broken (hereinafter, "malfunctioning slickline" 202), causing an obstruction in the borehole 104. In one or more embodiments, a slickline shredder tool 204 is lowered into the borehole 104 and positioned to engage with and remove the malfunctioning slickline 202.

In one or more embodiments described in connection with FIGS. 3-8, the slickline shredder tool 204 receives malfunctioning slickline 202 through a housing inlet 302 of a housing 304 of the slickline shredder tool 204, utilizes a shredder 306 to shred the malfunctioning slickline 202 into shredded pieces 308, and stores the shredded pieces 308 in a storage unit 310. In one or more embodiments, the same apparatus used to lower the tool 102 into the borehole 104 is used to lower the slickline shredder tool 204 into the borehole 104. In one or more embodiments, wireline equipment (not shown) or specialized equipment for this purpose is used to lower the slickline shredder tool 204 into the borehole 104.

Figure 3:
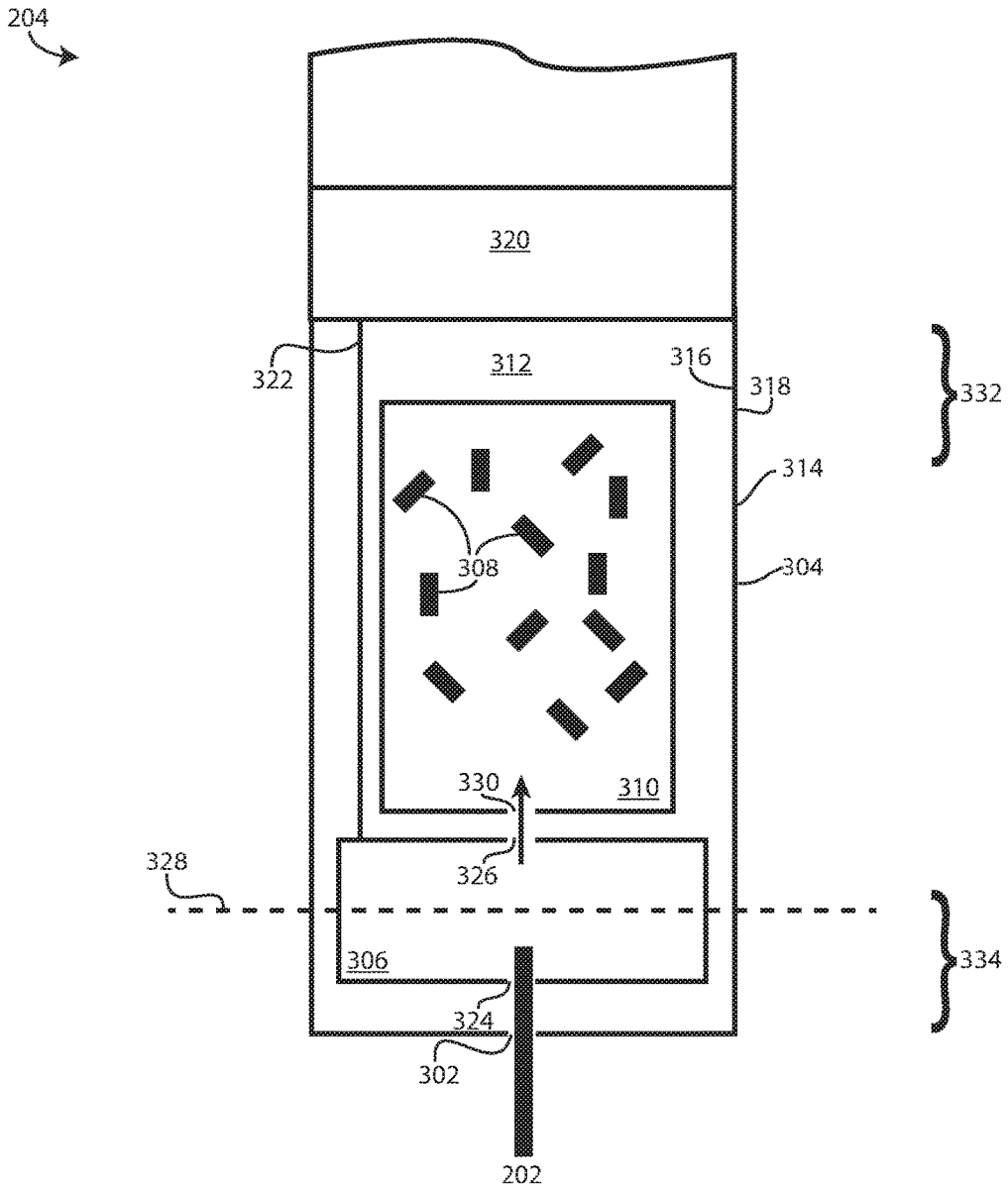
FIGS. 3-8 illustrate embodiments of a slickline shredder tool.

In one or more embodiments, as illustrated in FIG. 3, the housing 304 encloses a volume 312. In one or more embodiments, the housing 304 includes a wall 314. In one or more embodiments, the wall 314 includes an internal surface 316 facing the volume 312 and an external surface 318 that does not face the volume 312, i.e., is on the opposite side of the wall 314 from the internal surface 316. In one or more embodiments, the housing inlet 302 penetrates the wall 314. In one or more embodiments, the slickline shredder tool 204 includes a power receiver 320. In one or more embodiments, the power receiver 320 is directly and/or indirectly coupled to the shredder 306. For example, in one or more embodiments and as illustrated in FIG. 3, the direct or indirect coupling is indicated by a connection 322 between the power receiver and the shredder 306. In one or more embodiments, the connection 322 is an electrical connection. In one or more embodiments, the connection 322 is a mechanical connection. In one or more embodiments, the connection 322 is a combination of an electrical connection and a mechanical connection. In one or more embodiments, the shredder 306 includes a shredder inlet 324 and a shredder outlet 326. In one or more embodiments, the shredder 306 rotates about a first axis 328. In one or more embodiments, and as illustrated in FIG. 3, the storage unit 310 includes a storage unit inlet 330 through which it receives shredded pieces 308 (only 3 are labeled) of malfunctioning slickline 202.

In one or more embodiments, as illustrated in FIG. 3, the slickline shredder tool 204 includes a "power end" 332 adjacent to the power receiver 320 and an "inlet end" 334, which includes the housing inlet 302. In one or more embodiments, the power end 332 and the inlet end 334 are located on opposite ends of the slickline shredder tool 204. In one or more embodiments (not shown), neither the housing inlet 302 nor the power receiver 320 are limited to any particular location relative to the slickline shredder tool 204. For example, in one or more embodiments, the power receiver 320 is located within the housing 304. In one or more embodiments, the power receiver 320 is located outside the housing 304. In another example, and in one or more embodiments, the power receiver 320 may be positioned adjacent to the slickline shredder tool 204. In one or more embodiments, the power receiver 320 may not be adjacent to the slickline shredder tool 204. In one or more embodiments, the power end 332 and the inlet end 334 of the slickline shredder tool 204 are not located on opposite sides of the slickline shredder tool 204. In one or more embodiments, the power end 332 and the inlet end 334 of the slickline shredder tool 204 are on the same side of the slickline shredder tool 204.

In one or more embodiments, as illustrated in FIG. 3, the shredder inlet 324 and the shredder outlet 326 are on opposite sides of the shredder 306. In one or more embodiments (not shown), the shredder inlet 324 and the shredder outlet 326 are not on opposite sides of the shredder 306. In one or more embodiments (not shown), the shredder outlet 326 and the shredder inlet 324 are on adjacent sides of the shredder 306. In one or more embodiments (not shown), the shredder inlet 324 and the shredder outlet 326 are on the same side of the shredder 306.

In one or more embodiments, as illustrated in FIG. 3, the housing inlet 302 is in communication with the shredder inlet 324 and the shredder outlet 326 is in communication with the storage unit inlet 330. In one or more embodiments, malfunctioning slickline 202 enters the slickline shredder tool 204 through the housing inlet 302 and travels into the shredder 306 via the shredder inlet 324. In one or more embodiments, the power receiver 320 supplies power to the shredder 306 via the connection 322 and the shredder 306 rotates about the first axis 328 to shred the malfunctioning slickline 202 into shredded pieces 308. As illustrated in FIG. 3, the first axis 328 is a horizontal axis, but in one or more embodiments, the first axis 328 may have a different orientation (e.g., vertical). In one or more embodiments, the shredded pieces 308 of malfunctioning slickline 202 exit the shredder 306 via the shredder outlet 326 and enter the storage unit 310 via the storage unit inlet 330 and are stored therein.

Figure 4:
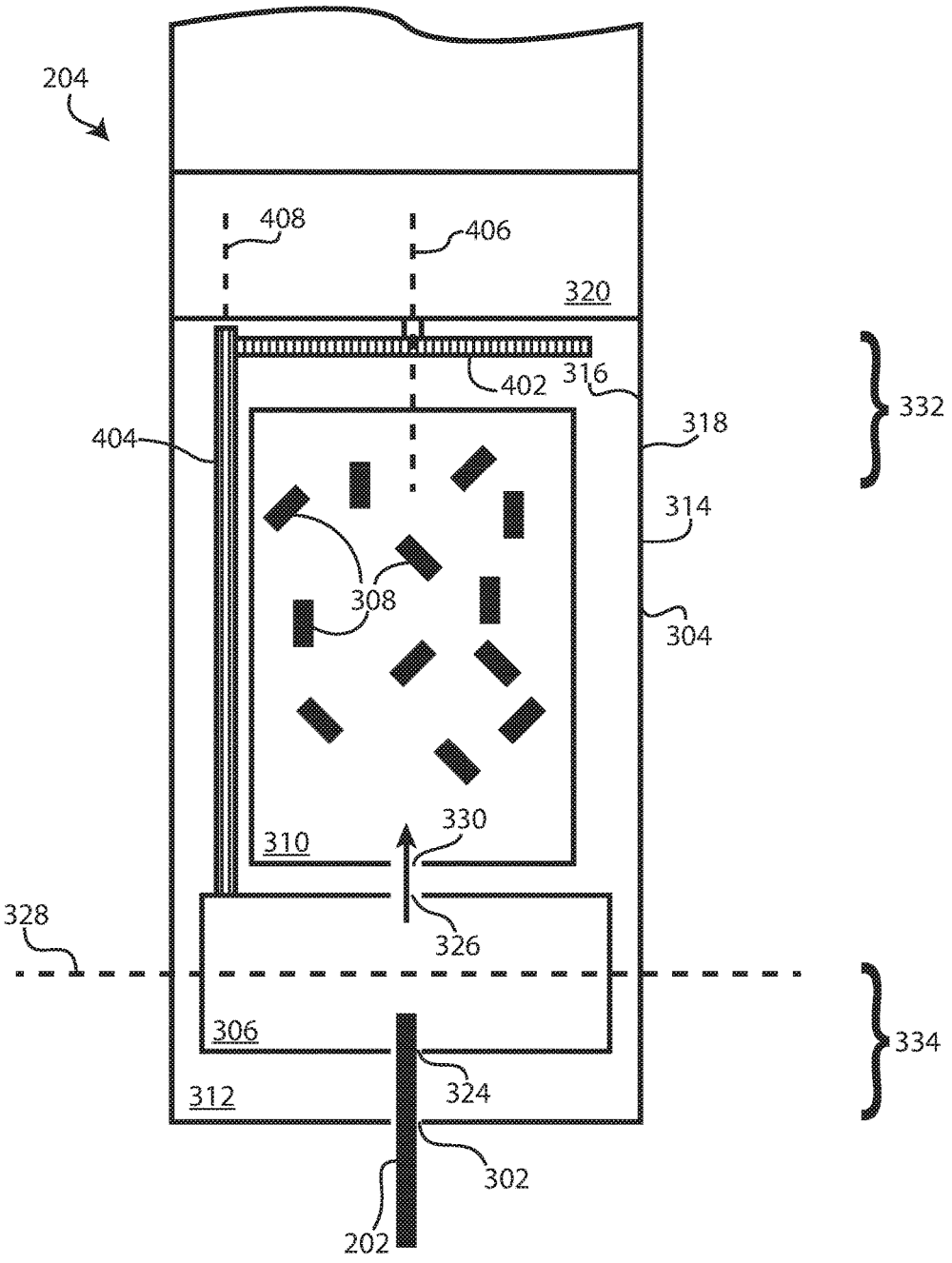

In one or more embodiments, as illustrated in FIGS. 3 and 4, the storage unit 310 is a discrete component housed in the slickline shredder tool 204 that stores shredded pieces 308 separate from the other internal components of the slickline shredder tool 204.

In one or more embodiments, as illustrated in FIGS. 5-8, the storage unit 310 is not a discrete component housed in the slickline shredder tool 204, but is instead a portion of the volume 312. In one or more embodiments (not shown), the storage unit 310 is located externally to the slickline shredder tool 204. In one or more embodiments (not shown), there is no storage unit 310 and the shredded pieces 308 of malfunctioning slickline 202 fall back into the borehole 104 or another location. In one or more embodiments, the slickline shredder tool 204 uses a sensor or sensors (such as a weight sensor, a sensor similar to a float valve, or a microwave proximity detector)(not shown), to determine when the storage unit 310 is filled to a threshold amount (e.g., 50 percent full, 75 percent full, 90 percent full, etc.) with shredded pieces 308 of malfunctioning slickline 202 so that the slickline shredder tool 204 may be retrieved from the borehole 104 and the storage unit 310 may be emptied.

In one or more embodiments (not shown), the shredder 306 is a set of helical cylindrical cutters or planetary cutters set at a diverging angle to each other. In one or more embodiments, such helical cylindrical cutters are similar in design to the sharpening mechanism in a planetary pencil sharpener. In one or more embodiments, the shredder 306 may be designed and shaped differently depending on the properties of the malfunctioning slickline 202 so as to efficiently shred such malfunctioning slickline 202. For example, in one or more embodiments (not shown), the shredder 306 includes meshed gears that shred where the gears mesh or a gear urged against a gear wall, such that the shredding occurs where the gear meets the gear wall.

In one or more embodiments, as illustrated in FIG. 4, in which the slickline shredder tool 204 is similar to the embodiment illustrated in FIG. 3, the connection 322 is a mechanical connection and includes a rotary unit 402 (e.g., a gear) and a rod 404 contained in the housing 304. In one or more embodiments, the power receiver 320, which receives electrical or mechanical power from a source (not shown), is mechanically coupled to the rotary unit 402, the rotary unit 402 is mechanically coupled to the rod 404 (e.g., by gears), and the rod 404 is mechanically coupled to the shredder 306. In one or more embodiments, the rotary unit 402 rotates about a second axis 406 and the rod 404 rotates about a third axis 408. In one or more embodiments, the power receiver 320 supplies mechanical power to the rotary unit 402 and, in response, the rotary unit 402 rotates about the second axis 406. In one or more embodiments, the rod 404 rotates about the third axis 408 in response to the rotary unit 402 rotating about the second axis 406. In one or more embodiments, the shredder 306 rotates about the first axis 328 to perform the shredding action in response to the rod 404 rotating about the third axis 408.

In one or more embodiments, the second axis 406 and the third axis 408 are vertical axes. In one or more embodiments, the rotary unit 402 and the rod 404 rotate around different axes than those shown. In one or more embodiments, the second axis 406 and the third axis 408 are substantially parallel. In one or more embodiments, substantially parallel means within five degrees of parallel. In one or more embodiments, substantially parallel means within ten degrees of parallel. In one or more embodiments, substantially parallel means within twenty degrees of parallel. In one or more embodiments, as illustrated in FIG. 4, the first axis 328 is substantially perpendicular to at least one of the second axis 406 and third axis 408. In one or more embodiments, substantially perpendicular means within five degrees of perpendicular. In one or more embodiments, substantially perpendicular means within ten degrees of perpendicular. In one or more embodiments, substantially perpendicular means within twenty degrees of perpendicular.

In one or more embodiments, as illustrated in FIGS. 3 and 4, the shredder 306 is in close proximity to the housing inlet 302. In one or more embodiments, the shredder 306 abuts the housing inlet 302. In one or more embodiments, there is a gap between the shredder 306 and the housing inlet 302.

In one or more embodiments, the gap is less than ¼ inch. In one or more embodiments, the gap is less than ½ inch. In one or more embodiments, the gap is less than 1 inch.

In one or more embodiments, as illustrated in FIGS. 5-8, the shredder 306 is not in close proximity to the housing inlet 302. In one or more embodiments, an internal guide 502 is included in the slickline shredder tool 204 to guide the malfunctioning slickline 202 from the housing inlet 302 towards the shredder 306 to prevent the malfunctioning slickline 202 from escaping the shredder 306. In one or more embodiments, the internal guide 502 includes an internal guide inlet 504 in communication with the housing inlet 302, an internal guide outlet 506 in communication with the shredder inlet 324, and an internal guide passage 508 between the internal guide inlet 504 and the internal guide outlet 506. In one or more embodiments, the internal guide inlet 504 is coupled to the housing inlet 302 and the internal guide outlet 506 is coupled to the shredder inlet 324. In one or more embodiments, the internal guide inlet 504 is adjacent to the housing inlet 302 and the internal guide outlet 506 is adjacent to the shredder inlet 324. In one or more embodiments, the internal guide inlet 504 is coupled to the housing inlet 302 and the internal guide outlet 506 is adjacent to the shredder inlet 324. In one or more embodiments, the internal guide inlet 504 is adjacent to the housing inlet 302 and the internal guide outlet 506 is coupled to the shredder inlet 324.

Figure 5:
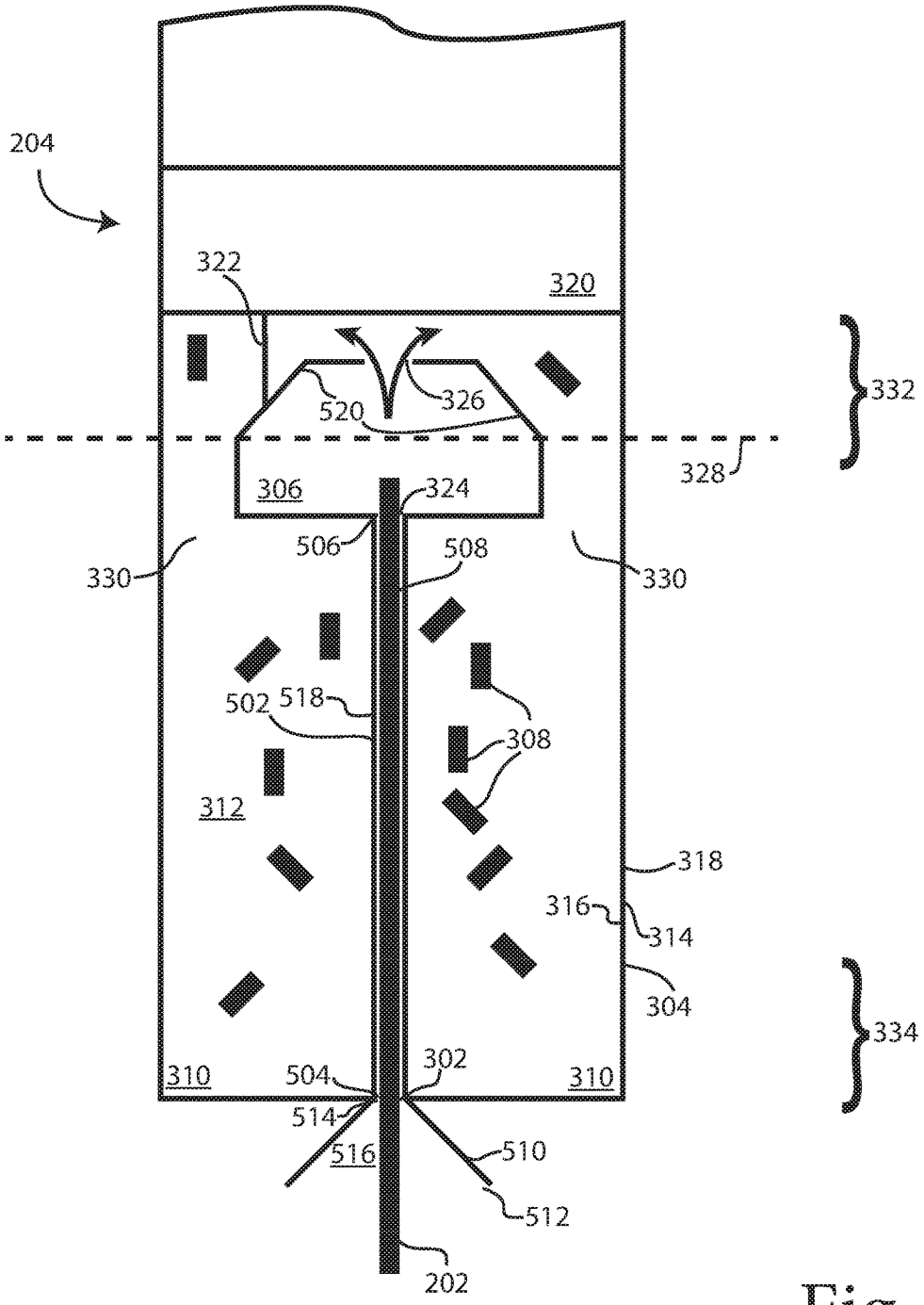

In one or more embodiments, as illustrated in FIG. 5, the slickline shredder tool 204 includes an external guide 510. In one or more embodiments, the external guide 510 is external to the housing 304 and includes an external guide inlet 512, an external guide outlet 514 in communication with the housing inlet 302 and an external guide passage 516 between the external guide inlet 512 and the external guide outlet 514.

In one or more embodiments, the internal guide 502 is a cylindrical-shaped tube 518. In one or more embodiments, the tube 518 is not limited to a cylindrical shape and instead may be differently shaped, such as a square tube. In one or more embodiments, malfunctioning slickline 202 is guided by the external guide 510 from the borehole 104 into the housing inlet 302. In one or more embodiments, as illustrated in FIG. 5, the malfunctioning slickline 202 travels through the housing inlet 302 and is guided by the tube 518 into the shredder 306 via the shredder inlet 324. In one or more embodiments, the shredder 306 is directly coupled to the power receiver 320 via the connection 322, which may be an electrical connection or a mechanical connection. In one or more embodiments, the shredder 306 receives power from the power receiver 320 and rotates about the first axis 328 to shred the malfunctioning slickline 202 into shredded pieces 308. In one or more embodiments, as illustrated in FIG. 5, shredded pieces 308 of malfunctioning slickline 202 exit the shredder outlet 326 and deposit into the storage unit 310. In one or more embodiments, the shredder 306 includes shoulders 520 to encourage shredded pieces 308 to exit the shredder outlet 326 and move into the storage unit 310.

Figure 6:
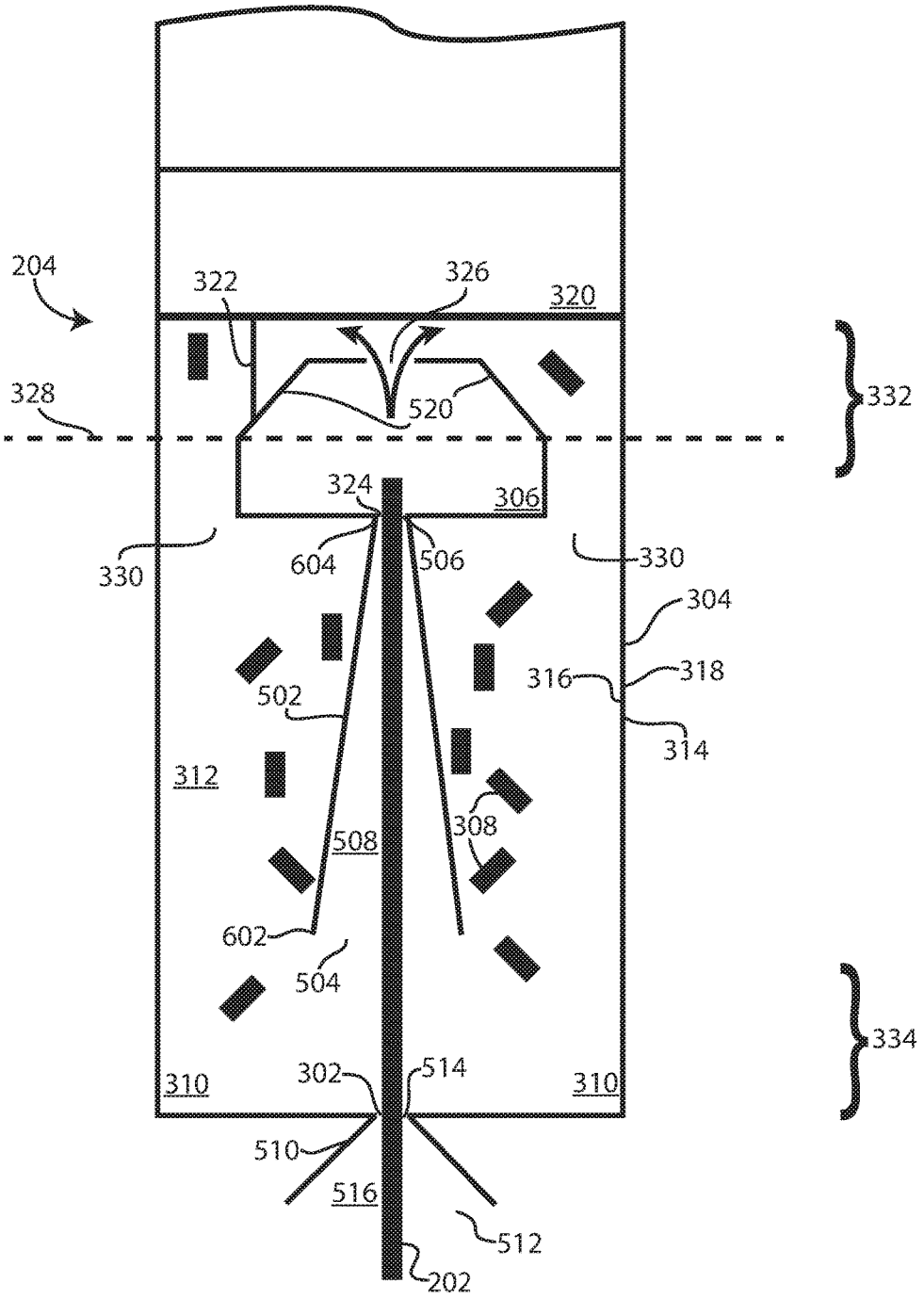

The embodiment of the slickline shredder tool 204 illustrated in FIG. 6 is similar to FIG. 5 and functions in the same way as the embodiment illustrated in FIG. 5 except that the internal guide 502 is not a tube 518. In one or more embodiments, as illustrated in FIG. 6, the internal guide 502 is funnel shaped such that the internal guide inlet 504 is a wide end 602 of the funnel-shaped internal guide 502 and the internal guide outlet 506 is a narrow end 604 of the funnel-shaped internal guide 502. In one or more embodiments, the internal guide inlet 504 is adjacent to the wide end 602 of the internal guide passage 508 and the internal guide outlet 506 is adjacent to the narrow end 604 of the internal guide passage 508. In one or more embodiments, the internal guide inlet 504 is the wide end 602 of the funnel-shaped internal guide 502 and the internal guide outlet 506 is adjacent to the narrow end 604 of the internal guide passage 508. In one or more embodiments, the internal guide inlet 504 is adjacent to the wide end 602 of the internal guide passage 508 and the internal guide outlet 506 is the narrow end 604 of the funnel-shaped internal guide 502.

Figure 7:
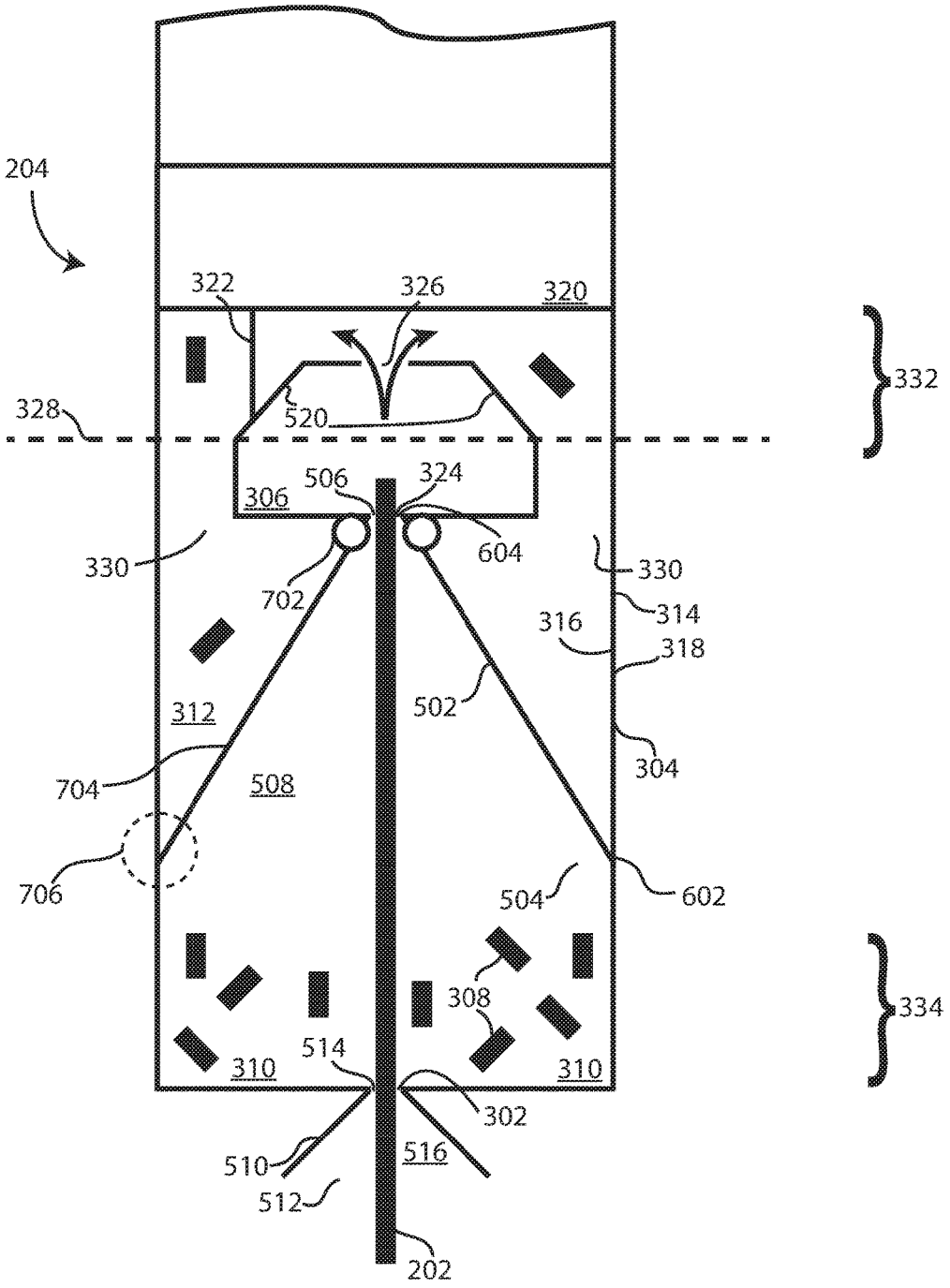
Figure 8:
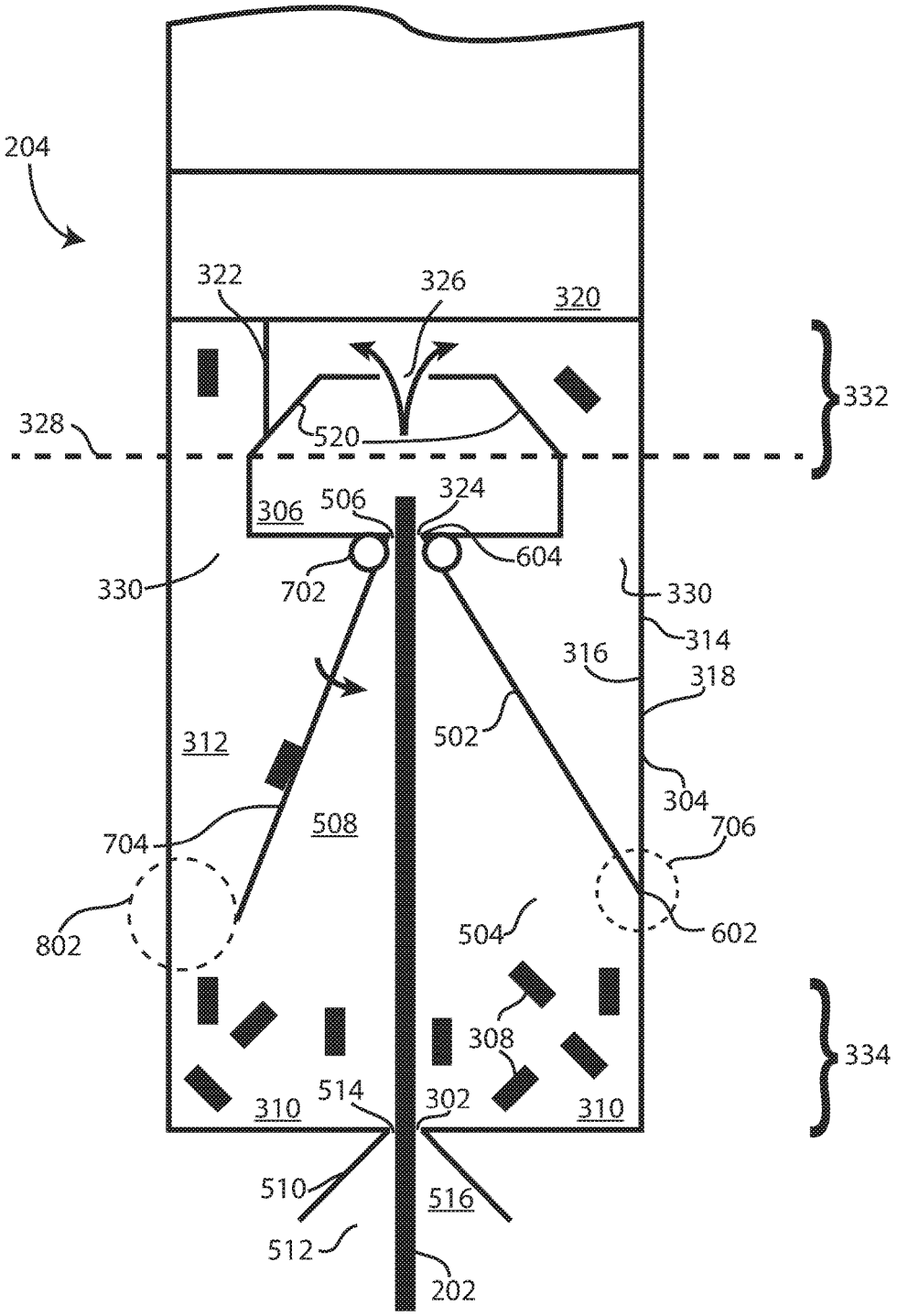

In one or more embodiments, as illustrated in FIGS. 7 and 8, the slickline shredder tool 204 is similar to the embodiments illustrated in FIGS. 5 and 6, except that the internal guide 502 includes a spring-loaded hinge 702 and a longitudinal flap 704 and is not a tube 518. In one or more embodiments, the longitudinal flap 704 is curved to match the shape of the housing 304. In one or more embodiments, the longitudinal flap 704 has two ends: a first end coupled to the spring-loaded hinge 702 and a second end urged against the internal surface 316 of the wall 314 of the housing 304. In one or more embodiments, the longitudinal flap 704 is movable from a first position 706 (see FIG. 7, referencing a dashed-line that circles an illustration of the first position 706) in which the second end is in contact with the internal surface 316 of the wall 314 of the housing 304 to a second position 802 (see FIG. 8, referencing a dashed-line that circles an illustration of the second position 802) in which the second end is not in contact with the internal surface 316 of the wall 314 of the housing 304. In one or more embodiments, there is a plurality of longitudinal flaps 704 and spring-loaded hinges 702. In one or more embodiments, the longitudinal flap 704 inhabits the first position 706 when the slickline shredder tool 204 is in a state of equilibrium. In one or more embodiments, and as illustrated in FIG. 7, shredded pieces 308 of malfunctioning slickline 202 exiting the shredder 306 towards the storage unit 310 are prevented by the longitudinal flap 704 from depositing into the storage unit 310 because the longitudinal flap 704 is in the first position 706. In one or more embodiments, and as illustrated in FIG. 8, the weight of the shredded pieces 308 on at least a part of the longitudinal flap 704 causes such longitudinal flap 704 to move from the first position 706 to the second position 802, therein permitting such shredded pieces 308 to slide or travel from the longitudinal flap 704 into the storage unit 310. In one or more embodiments, after such shredded pieces 308 have traveled into the storage unit 310, such longitudinal flap 704 will move back to the first position 706.

Depending on the characteristics of the malfunctioning slickline 202, the shape, dimensions and type of internal guide 502 may be modified to best accommodate such malfunctioning slickline 202. For example, malfunctioning slickline 202 that is rigid and/or long may possess a lower likelihood of missing the shredder 306, and for this reason, the embodiment illustrated in FIG. 6 may be sufficient to ensure such malfunctioning slickline 202 entering the housing 304 will be guided to the shredder 306. In another example, malfunctioning slickline 202 that is flexible and/or short in length may possess a greater likelihood of missing the shredder 306, and for this reason, the embodiment illustrated in FIG. 5 (i.e. tube 518) or FIGS. 7 and 8 may be better suited for such malfunctioning slickline 202.

In one aspect, an apparatus includes a housing for use in a downhole environment. The housing encloses a volume. The housing includes a wall. The wall includes an internal surface facing the volume and an external surface. A housing inlet penetrates the wall. A power receiver is contained in the housing. A shredder is contained in the housing. The shredder is coupled to the power receiver. The shredder includes a shredder inlet and a shredder outlet. The shredder inlet is in communication with the housing inlet. The shredder rotates about a first axis when the power receiver receives power. The shredder is capable of shredding a malfunctioning slickline received through the shredder inlet into shredded pieces. A storage unit is contained in the housing and capable of storing shredded pieces received from the shredder. The storage unit includes a storage unit inlet in communication with the shredder outlet.

Embodiments may include one or more of the following. The power receiver may include a rotary unit in the housing. The rotary unit may rotate about a second axis. The housing may include a rod. The rod may be coupled to the rotary unit. The rod may rotate about a third axis when the rotary unit rotates about the second axis. The shredder may be coupled to the rod. The shredder may rotate about the first axis when the rod rotates about the third axis. The second axis and third axis may be substantially parallel. The first axis may be substantially perpendicular to at least one of the second axis and third axis. The housing may include an external guide. The external guide may be external to the housing. The external guide may include an external guide inlet, an external guide outlet in communication with the housing inlet, and an external guide passage between the external guide inlet and the external guide outlet. The housing may include an internal guide. The internal guide may be contained in the housing. The internal guide may include an internal guide inlet in communication with the housing inlet. The internal guide inlet may be positioned to capture malfunctioning slickline entering the housing inlet. The internal guide may include an internal guide outlet in communication with the shredder inlet. The internal guide may include an internal guide passage between the internal guide inlet and the internal guide outlet. The internal guide may be a tube. The internal guide may include a spring-loaded hinge and a longitudinal flap. The longitudinal flap may be coupled at a first end to the spring-loaded hinge and urged at a second end against the internal surface of the wall of the housing. The longitudinal flap may be movable from a first position in which the second end is in contact with the internal surface of the wall of the housing to a second position in which the second end is not in contact with the internal surface of the wall of the housing. The internal guide passage may include a wide end and a narrow end. The wide end may be adjacent to the internal guide inlet and the narrow end may be adjacent to the internal guide outlet. The wide end may be the internal guide inlet and the narrow end may be the internal guide outlet.

In one aspect, a method includes lowering a slickline shredder tool into a borehole and positioning the slickline shredder tool downhole near the malfunctioning slickline in the borehole. The method includes receiving the malfunctioning slickline through the housing inlet. The method includes receiving power into the power receiver. The method includes supplying power from the power receiver to the shredder. The method includes shredding the malfunctioning slickline into shredded pieces and storing the shredded pieces in the storage unit.

In one aspect, a system includes a surface equipment module located on a surface of the earth, a slickline shredder tool located in a borehole, and a slickline cable coupled to the slickline shredder tool and to the surface equipment module.

The word "coupled" herein means a direct connection or an indirect connection. The words "in communication" herein means a direct connection or an indirection connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a housing for use in a downhole environment, the housing enclosing a volume, the housing comprising:
- a wall comprising:
  - an internal surface facing the volume, and
  - an external surface; and
- a housing inlet that penetrates the wall;

a power receiver contained in the housing;

a shredder contained in the housing and coupled to the power receiver, the shredder comprising:
- a shredder inlet in communication with the housing inlet, and
- a shredder outlet,
- wherein:
  - the shredder rotates about a first axis when the power receiver receives power, and
  - the shredder is capable of shredding a malfunctioning slickline received through the shredder inlet into shredded pieces; and a storage unit contained in the housing and capable of storing shredded pieces received from the shredder.

2. The apparatus of claim 1, wherein the storage unit comprises a storage unit inlet in communication with the shredder outlet.

3. The apparatus of claim 1, wherein:

the power receiver comprises a rotary unit contained in the housing, wherein the rotary unit rotates about a second axis;

the apparatus further comprises a rod contained in the housing and coupled to the rotary unit, wherein the rod rotates about a third axis when the rotary unit rotates about the second axis; and the shredder is coupled to the rod, wherein the shredder rotates about the first axis when the rod rotates about the third axis.

4. The apparatus of claim 3, wherein the second axis and the third axis are substantially parallel.

5. The apparatus of claim 3, wherein the first axis is substantially perpendicular to at least one of the second axis and third axis.

6. The apparatus of claim 1 comprising:

an external guide, external to the housing, the external guide comprising:
- an external guide inlet;
- an external guide outlet in communication with the housing inlet; and
- an eternal guide passage between the external guide inlet and the external guide outlet.

7. The apparatus of claim 1, further comprising:

an internal guide contained in the housing, the internal guide comprising:

an internal guide inlet in communication with the housing inlet and positioned to capture malfunctioning slickline entering the housing inlet;

an internal guide outlet in communication with the shredder inlet; and an internal guide passage between the internal guide inlet and the internal guide outlet.

8. The apparatus of claim 7, wherein the internal guide is a tube.

9. The apparatus of claim 7, wherein the internal guide further comprises:

a spring-loaded hinge; and a longitudinal flap coupled at a first end to the spring-loaded hinge and urged at a second end against the internal surface of the wall of the housing;

wherein the longitudinal flap is movable from a first position in which the second end is in contact with the internal surface of the wall of the housing and a second position in which the second end is not in contact with the internal surface of the wall of the housing.

10. The apparatus of claim 7, wherein:

the internal guide passage further comprises:

a wide end adjacent to the internal guide inlet, and a narrow end adjacent to the internal guide outlet.

11. A method comprising:

lowering a slickline shredder tool into a borehole, the slickline shredder tool comprising:

a housing for use in a downhole environment, the housing enclosing a volume, the housing comprising:

a wall comprising:

an internal surface facing the volume, and an external surface; and a housing inlet that penetrates the wall;

a power receiver contained in the housing;

a shredder contained in the housing and coupled to the power receiver, the shredder comprising:

a shredder inlet in communication with the housing inlet, and a shredder outlet, wherein:

the shredder rotates about a first axis when the power receiver receives power, and the shredder is capable of shredding a malfunctioning slickline received through the shredder inlet into shredded pieces; and a storage unit contained in the housing and capable of storing shredded pieces received from the shredder;

positioning the slickline shredder tool downhole near the malfunctioning slickline in the borehole;

receiving the malfunctioning slickline through the housing inlet;

receiving power into the power receiver;

supplying power from the power receiver to the shredder;

shredding the malfunctioning slickline into shredded pieces; and storing the shredded pieces in the storage unit.

12. The method of claim 11, wherein the storage unit comprises a storage unit inlet in communication with the shredder outlet.

13. The method of claim 11, wherein:

the power receiver comprises a rotary unit contained in the housing, wherein the rotary unit rotates about a second axis;

the slickline shredder tool further comprises a rod contained in the housing and coupled to the rotary unit, wherein the rod rotates about a third axis when the rotary unit rotates about the second axis; and the shredder is coupled to the rod, wherein the shredder rotates about the first axis when the rod rotates about the third axis.

14. The method of claim 13, wherein the second axis and the third axis are substantially parallel.

15. The method of claim 13, wherein the first axis is substantially perpendicular to at least one of the second axis and third axis.

16. The method of claim 11, further comprising:

an external guide, external to the housing, the external guide comprising:

an external guide inlet;

an external guide outlet in communication with the housing inlet; and an external guide passage between the external guide inlet and the external guide outlet.

17. The method of claim 11, further comprising:

an internal guide contained in the housing, the internal guide comprising:

an internal guide inlet in communication with the housing inlet and positioned to capture malfunctioning slickline entering the housing inlet;

an internal guide outlet in communication with the shredder inlet; and an internal guide passage between the internal guide inlet and the internal guide outlet.

18. The method of claim 17, wherein the internal guide further comprises:

a spring-loaded hinge; and a longitudinal flap coupled at a first end to the spring-loaded hinge and urged at a second end against the internal surface of the wall of the housing;

wherein the longitudinal flap is movable from a first position in which the second end is in contact with the internal surface of the wall of the housing and a second position in which the second end is not in contact with the internal surface of the wall of the housing.

19. The method of claim 17, wherein:

the internal guide passage further comprises:

a wide end adjacent to the internal guide inlet, and a narrow end adjacent to the internal guide outlet;

the wide end is the internal guide inlet; and the narrow end is the internal guide outlet.

20. A system comprising:

a surface equipment module located on a surface of the earth;

a slickline shredder tool located in a borehole, the slickline shredder tool comprising:

a housing for use in a downhole environment, the housing enclosing a volume, the housing comprising:

a wall comprising:

an internal surface facing the volume, and an external surface; and a housing inlet that penetrates the wall;

a power receiver contained in the housing;

a shredder contained in the housing and coupled to the power receiver, the shredder comprising:

a shredder inlet in communication with the housing inlet, and a shredder outlet, wherein:

the shredder rotates about a first axis when the power receiver receives power, and the shredder is capable of shredding a malfunctioning slickline received through the shredder inlet into shredded pieces; and a storage unit contained in the housing and capable of storing shredded pieces received from the shredder; and a slickline cable coupled to the slickline shredder tool and to the surface equipment module.

* * * * *